US005489324A

United States Patent [19]

Takahasi et al.

[11] Patent Number: 5,489,324

[45] Date of Patent: Feb. 6, 1996

[54] FE-BASED SINTERED ALLOY HAVING WEAR RESISTANCE

[75] Inventors: Yositaka Takahasi, Toyota; Akira Manabe, Aichi; Tadataka Kaneko, Nagoya; Hiroshi Okajima, Toyota; Yoshihiko Ito, Toyota; Setsuto Daiza, Toyota, all of Japan

[73] Assignee: Toyota Jidosha Kabushiki Kaisha, Toyota, Japan

[21] Appl. No.: 429,846

[22] Filed: Apr. 27, 1995

Related U.S. Application Data

[62] Division of Ser. No. 158,313, Nov. 29, 1993.

[30] Foreign Application Priority Data

| | | | |
|---|---|---|---|
| Nov. 27, 1992 | [JP] | Japan | 4-318428 |
| Dec. 4, 1992 | [JP] | Japan | 4-325713 |
| Dec. 4, 1992 | [JP] | Japan | 4-325714 |
| Mar. 19, 1993 | [JP] | Japan | 5-060095 |
| Sep. 24, 1993 | [JP] | Japan | 5-238449 |
| Sep. 24, 1993 | [JP] | Japan | 5-238454 |
| Oct. 15, 1993 | [JP] | Japan | 5-258709 |

[51] Int. Cl.[6] ..... C22C 33/00

[52] U.S. Cl. ..... 75/246; 75/243

[58] Field of Search ..... 75/243, 246

[56] References Cited

U.S. PATENT DOCUMENTS

| | | | |
|---|---|---|---|
| 3,795,961 | 3/1974 | Takahashi et al. | 29/182 |
| 3,810,756 | 5/1974 | Koehler et al. | 75/214 |
| 4,080,205 | 3/1978 | Niimi et al. | 75/241 |
| 4,274,876 | 6/1981 | Kodama et al. | 75/243 |
| 4,552,590 | 11/1985 | Nakata et al. | 75/246 |
| 4,731,118 | 3/1988 | Svilar et al. | 75/246 |
| 4,769,071 | 9/1988 | Klar et al. | 75/246 |
| 4,915,735 | 4/1990 | Motooka | 75/231 |

*Primary Examiner*—Ngoclan Mai

*Attorney, Agent, or Firm*—Oblon, Spivak, McClelland, Maier, & Neustadt

[57] ABSTRACT

Disclosed are an Fe-based alloy powder adapted for sintering, an Fe-based sintered alloy, and a process for producing the Fe-based sintered alloy. The Fe-based alloy powder or the matrix of the Fe-based sintered alloy consists, percent by weight, essentially of 2.0 to 15% Co, 2.0 to 10% Mo, and the balance of Fe and inevitable impurities. The Fe-based alloy powder exhibits superb compressibility and corrosion resistance, and accordingly the Fe-based sintered alloy made therefrom exhibits excellent wear resistance, corrosion resistance and oxidation resistance. The Fe-based sintered alloy is further improved in the excellent properties by dispersing novel Ni-based alloy hard particles in the matrix.

13 Claims, 3 Drawing Sheets

FE-BASED SINTERED ALLOY HAVING WEAR RESISTANCE

This is a Division of application Ser. No. 08/158,313 filed on Nov. 29, 1993.

BACKGROUND OF THE INVENTION

1. Field of the Invention

The present invention relates to an Fe-based alloy powder adapted for sintering and having superb compressibility and corrosion resistance, and an Fe-based sintered alloy having superb wear resistance. The Fe-based alloy powder and sintered alloy are useful to make sintered component parts, such as valve seats and piston rings for internal combustion engines, collars for exhaust systems, and the like. The present invention also relates to a process for producing the Fe-based sintered alloy.

2. Description of Related Art

Japanese Unexamined Patent Publication (KOKAI) No. 56-154,110 discloses a conventional alloy for making the valve seats. The conventional alloy is prepared by adding an intermetallic compound, such as ferromolybdenum (e.g., Fe-Mo) or ferrochromium (e.g., Fe-Cr), or an Fe-C-Cr-Mo-V alloy, to an Fe-C-Co-Ni-based alloy or an Fe-C-based alloy in order to improve the wear resistance.

Japanese Unexamined Patent Publication (KOKAI) No. 60-224,762 discloses a sintered alloy. In this sintered alloy, Fe-based hard particles containing Cr, Mo and V are dispersed in the Fe-C matrix containing Cr and Mo in order to improve the wear resistance and the harshness against mating parts.

Japanese Unexamined Patent Publication (KOKAI) No. 62-202,058 discloses another sintered alloy. In this sintered alloy, hard particles including FeMo and FeW are dispersed in the Fe-C-Co-Ni matrix, and a Pb alloy or the like is impregnated thereinto in order to enhance the wear resistance.

The alloys for making the valve seats are required to have the corrosion resistance and the heat resistance in addition to the wear resistance. In the aforementioned sintered alloys, the hard particles mainly effect the wear resistance, and the matrices mainly effect the corrosion resistance and the heat resistance. Thus, the hard particles and the matrices cooperatively effect the durability securely.

Recently, in the field of automobile engines, the following improvement requirements have been demanded more strongly than ever: the extension of longevity, the increment of output, the increment of speed, the countermeasure against exhaust gas, the countermeasure against fuel consumption, and the like. Therefore, the engine valves, the valves seats, and the like of the automobile engines must inevitably withstand much severer service environments than ever. Accordingly, they are required to have further improved heat resistance and wear resistance, and they are also required to have enhanced corrosion resistance at elevated temperatures.

When forming the matrices of the conventional Fe-based alloys for making the valve seats, each ingredient powder of the alloying elements, such as Ni, Co, Mo, and the like, is mixed with an iron powder to make a mixed powder, i.e., a raw material. Thereafter, the resulting mixed powder is formed and sintered, thereby diffusing Ni, Co, Mo, and the like into the iron. For instance, as set forth in Japanese Unexamined Patent Publication (KOKAI) No. 3-158,444, an Fe-Cr powder, a carbonyl powder, a Co powder, an Mo powder and a graphite powder are prepared as raw material powders for making an Fe-based sintered alloy for valve seats. The raw material powders are then mixed with hard particles to produce valve seats made of an Fe-based sintered alloy in which the hard particles are dispersed in the Fe-based alloy matrix.

However, it is hard to completely diffuse the alloying elements into the iron. As a result, it is difficult to improve the physical properties of the resulting Fe-based sintered alloys in proportion to their addition amounts.

Hence, one might think of alloying iron and the alloying elements in advance in order to effectively produce the advantageous effects resulting from the addition of the alloying elements. However, when alloying iron and the alloying elements in advance, the resulting Fe-based alloy powders exhibit deteriorated compressibility because of the solution hardening, thereby making it difficult to highly densify the green compacts. As a result, it is disadvantageous when improving the products made of the Fe-based alloy powders in terms of the durability.

SUMMARY OF THE INVENTION

The present invention has been developed in order to solve the problems associated with the conventional Fe-based alloys used for making the valve seats, or the conventional Fe-based alloy powders used for making the conventional Fe-based alloys.

It is therefore an object of the present invention to provide an Fe-based sintered alloy whose heat resistance and wear resistance are remarkably improved so as to withstand the severer service environments to which the recent valve seats or the like are subjected, to provide an Fe-based alloy powder adapted for sintering whose compressibility and corrosion resistance are enhanced, and to provide a process for producing the Fe-based sintered alloy.

As aforementioned, when alloying the additive elements with the iron powder, there arises the solution hardening in the resulting conventional Fe-based alloys, thereby they exhibit the deteriorated compressibility. Accordingly, the inventors of the present invention carried out a research and development extensively on the content ranges of the additive elements where no solution hardening occurs when the alloying is carried out. As a result, they discovered novel Fe-based alloy powders which can securely exhibit the compressibility when the powders have special compositions and the contents of the additive elements fall in certain ranges. They still carried out the research and development on improving the corrosion resistance and the wear resistance of novel sintered alloys made of the novel Fe-based alloy powders having the special compositions whose contents fall in the specific ranges. As a result, they discovered that the resulting sintered alloys can be improved sharply in the corrosion resistance and the wear resistance when the additive elements are combined specially. The inventors thus completed the present invention.

Further, the inventors continued to carry out the research and development in order to further enhance the novel sintered alloys in terms of the corrosion resistance and the seizure resistance, and they made a numerous number of experiments diligently on the following in order to optimize the novel sintered alloys for the valve seats or the like: the chemical components and the alloyed forms of the matrices, the relationship between the structures of the matrices and the wear resistance, infiltrating metals or alloys applicable thereto, the relationship between the infiltration amount and the wear resistance, and the relationship between the infiltration amount and the seizure resistance. As a result, they discovered specific compositions, alloyed forms and infiltrating metals or alloys for the matrices which enable the novel sintered alloy to exhibit further superb wear resistance and seizure resistance.

Furthermore, the inventors continued to extensively investigate into the following in order to furthermore improve the novel sintered alloys in terms of the wear resistance, the corrosion resistance and the oxidation resistance so as to furthermore optimize the novel sintered alloys for the valve seats or the like: the chemical components and the alloyed forms, the types of hard particles to be dispersed therein and their addition amounts, and the structures of the matrices and the sintering conditions. As a result, they discovered specific compositions and alloyed forms for the matrices which can effectively give the novel sintered alloys excellent oxidation resistance and corrosion resistance, and they also discovered that the novel sintered alloys can be improved remarkably in the wear resistance, the corrosion resistance and the oxidation resistance by dispersing novel hard particles having specific compositions therein, novel hard particles which effect remarkably good wear resistance while retaining the superb oxidation resistance and corrosion resistance. They also found that the novel sintered alloys with the novel hard particles dispersed therein are economical over the conventional alloys. They thus completed modifying the present invention.

Moreover, the novel sintered alloys are likely to be subjected to machining during manufacturing processes, e.g., during a process to finish them to final component parts. The improvements on the properties are expected to usually result in the deterioration in their machinability, and the degraded machinability is expected to adversely affect the manufacturing costs (e.g., rising processing costs or the like) and the production efficiency associated therewith. The novel sintered alloys are thus expected to have the enhanced properties and, at the same time, not to be deteriorated in the machinability. The present inventors also investigated into free-machining additives to be dispersed in the matrices, which are capable of least deteriorating the improved properties of the novel sintered alloys, and their addition amounts. They thus completed enhancing the machinability of the novel sintered alloy.

According to the present invention, an Fe-based alloy powder adapted for sintering and having superb compressibility and corrosion resistance consists, percent by weight, essentially of:

Co in an amount of 2.0 to 15%;

Mo in an amount of 2.0 to 10%; and the balance of Fe and inevitable impurities.

Further, according to the present invention, an Fe-based sintered alloy having superb wear resistance is prepared by mixing an Fe-based alloy powder with a graphite powder and a forming lubricant, and by forming and sintering the resulting mixture;

the Fe-based alloy powder consisting, percent by weight, essentially of:

Co in an amount of 2.0 to 15%;

Mo in an amount of 2.0 to 10%; and the balance of Fe and inevitable impurities; and the graphite powder mixed in an amount of 0.20 to 2.1% by weight.

The present Fe-based sintered alloy can be improved in terms of the corrosion resistance and the seizure resistance by infiltrating and diffusing an infiltrating alloy in and around pores of the above-described Fe-based sintered alloy;

the infiltrating alloy infiltrated in an amount of 3.0 to 25% by weight, and including at least one member selected from the group consisting of Pb, Cu, Pb-Cu alloys, and alloys containing the Pb, Cu or Pb-Cu alloys as a major component.

The present Fe-based sintered alloy can be enhanced in terms of the corrosion resistance and the oxidation resistance by dispersing hard particles in the matrix;

the hard particles being at least one member selected from the group consisting of Fe-Mo-C, Fe-Cr-C and Fe-W-C hard particles, and mixed in an amount of 2.0 to 30% by weight in total;

the Fe-Mo-C hard particles consisting, percent by weight, essentially of Mo in an amount of 55 to 70%, C in an amount of 0.50% or less, and the balance of Fe and inevitable impurities;

the Fe-Cr-C hard particles consisting, percent by weight, essentially of Cr in an amount of 55 to 70%, C in an amount of 0.50% or less, and the balance of Fe and inevitable impurities; and the Fe-W-C hard particles consisting, percent by weight, essentially of W in an amount of 75 to 85%, C in an amount of 0.50% or less, and the balance of Fe and inevitable impurities.

The present Fe-based sintered alloy with the hard particles dispersed in the matrix can be modified to consist, percent by weight, essentially of, as a whole:

Co in an amount of 1.3 to 15%;

Mo in an amount of 1.3 to 16%;

Cr in an amount of 0.40 to 18%;

W in an amount of 0.050 to 6.0%;

C in an amount of 0.20 to 3.2%;

Ni in an amount of 0.20 to 17%; and the balance of Fe and inevitable impurities; and to include a matrix and hard particles dispersed in the matrix in an amount of 2.0 to 30% by weight;

the matrix consisting, percent by weight, essentially of:

Co in an amount of 2.0 to 15%;

Mo in an amount of 2.0 to 10%;

C in an amount of 0.20 to 2.0%;

Ni in an amount of 10% or less; and the balance of Fe and inevitable impurities; and the hard particles consisting, percent by weight, essentially of:

Cr in an amount of 20 to 75%;

W in an amount of 3.0 to 20%;

C in an amount of 0.50 to 5.0%; and the balance of Ni and inevitable impurities.

The modified present Fe-based sintered alloy, can be produced by a process comprising the steps of:

a mixing and forming step of mixing an Fe-based alloy powder with an Ni-based alloy powder, a graphite powder and a forming lubricant, thereby preparing a green compact; and a sintering step of sintering the green compact at a temperature of from 1,323 K. to a melting point or less of the Ni-based alloy powder;

the Fe-based alloy powder consisting, percent by weight, essentially of:

Co in an amount of 2.0 to 15%;

Mo in an amount of 2.0 to 10%; and the balance of Fe and inevitable impurities;

the Ni-based alloy powder mixed in an amount of 2.0 to 30% by weight, and consisting, percent by weight, essentially of:

Cr in an amount of 20 to 75%;

W in an amount of 3.0 to 20%; and the balance of Ni and inevitable impurities; and the graphite powder mixed in an amount of 0.20 to 2.1% by weight.

Hereinafter, the reasons for the limitations on the content ranges of the major components, such as the alloying elements, the additives, and the like, in the present invention will be described along with their operations and advantages.

Co in an amount of 2.0 to 15% in the present Fe-based alloy powder:

Co dissolves in the matrix so as to enhance it, and it improves the heat resistance and the corrosion resistance. When Co is included in an amount of less than 2.0%, the advantages are effected insufficiently. When Co is included in an amount of more than 15%, the advantages are enhanced but such an inclusion is not economical. In view of these, Co is included in the amount of 2.0 to 15%, preferably in an amount of 2.0 to 10%.

Mo in an amount of 2.0 to 10% in the present Fe-based alloy powder:

Mo dissolves in the matrix so as to enhance it, and it improves the strength of sintered alloys at elevated temperatures. In the case of sintered alloys containing C, part of Mo reacts with C to form carbide, thereby improving the wear resistance. When Mo is included in an amount of less than 2.0%, the advantages are effected insufficiently. When Mo is included in an amount of more than 10%, the advantages are enhanced appreciably, but such an inclusion results in the compressibility deterioration in the resulting powders. Accordingly, Mo is included in the amount of 2.0 to 10%, preferably in an amount of more than 3.0% (not inclusive) and up to 10%.

In particular, O and C contained in alloy powders deteriorate the compressibility. Hence, in the present Fe-based alloy powder, it is preferred that O is included in an amount of 0.30% or less, and that C is included in an amount of 0.20% or less.

The present Fe-based alloy powder or the matrix of the present Fe-based sintered alloy consists, percent by weight, essentially of Co in an amount of 2.0 to 15%, Mo in an amount of 2.0 to 10%, and the balance of Fe and inevitable impurities. Accordingly, the alloying elements are dissolved in the matrix highly homogeneously. Hence, the present Fe-based alloy powder, the present Fe-based sintered alloy or the matrix thereof can exhibit superb corrosion resistance, oxidation resistance and wear resistance with small amounts of the alloying elements, compared to the conventional counterparts made by mixing the ingredient element powders.

Especially, the present Fe-based alloy powder exhibits compressibility which is less likely to deteriorate, because the contents of the alloying elements are adjusted to fall in the aforementioned content ranges. Therefore, the present Fe-based alloy powder can exhibit compressibility which is equivalent to or slightly smaller than those exhibited by the conventional alloy powders made by mixing the ingredient element powders. Accordingly, the present Fe-based sintered alloy made therefrom cannot be adversely affected in terms of the oxidation resistance, the corrosion resistance, and the like, associated with the compressibility or the density.

In the present Fe-based sintered alloy, the alloying elements, e.g., Co and Mo, are dissolved in the Fe-based matrix uniformly, and the matrix is turned into bainite. Hence, the present Fe-based sintered alloy is superb in the wear resistance. On the other hand, in the conventional sintered alloys made by mixing the ingredient element powders, the concentrations of Mo and Co fluctuate therein. As a result, the matrix is turned into austenite where the concentration of austenite-generative Co is high, and it is turned into pearlite where the concentration of pearlite-generative Mo is high, thereby forming mixed structures. Therefore, the conventional sintered alloys are inferior in the wear resistance, and the like.

Infiltrating Alloy in an amount of 3.0 to 25% by weight:

In particular, the infiltration of the infiltrating alloys is carried out preferably when the present Fe-based sintered alloy is used to make valve seats or the like which are subjected to much harsher environments. For the infiltrating alloy, as aforementioned, the Pb, Cu, Pb-Cu alloys, or the alloys containing the Pb, Cu or Pb-Cu alloys as a major component are suitable. The infiltrated infiltrating alloy improves the wear resistance of the present Fe-based sintered alloy by the following operations: It intervenes between the contact areas of the valves and the valve seats so as to work as a lubricant, it improves the thermal conductivity of the present Fe-based sintered alloy, and it decreases the temperature on the contact area of the valve seats effectively.

When the infiltration amount of the Pb, Cu, Pb-Cu alloys, or the alloys containing Pb, Cu or Pb-Cu alloys as a major component is less than 3.0% by weight, no advantageous effect can be obtained by the infiltration. When it is more than 25% by weight, the skeleton becomes brittle or weakens so that there might arise adverse effects. Accordingly, the infiltrating alloy is infiltrated in the amount of 3.0 to 25% by weight, preferably in an amount of 5.0 to 20% by weight.

Hard Particles in an amount of 2.0 to 3.0% by weight:

In addition, it is preferred that the present Fe-based sintered alloy includes at least one of the hard particles selected from the group consisting of the Fe-Mo-C, Fe-Cr-C and Fe-W-C hard particles in an amount of 2.0 to 30% by weight in total. The Fe-Mo-C, Fe-Cr-C and Fe-W-C hard particles are dispersed in the matrix of the present Fe-based sintered alloy to improve the wear resistance.

When the hard particles are added in an amount of less than 2.0%, the wear resistance is improved improperly. When they are added in an amount of more than 30%, the wear resistance is improved less regardless of the addition, and such an addition results in the deterioration in the formability of the resulting green compacts or sintered alloys. Thus, the hard particles are added to the present Fe-based sintered alloy powder or dispersed in the present Fe-based sintered alloy in the amount of 2.0 to 30%. Further, it is preferred that they are added in an amount of 5.0 to 25% by weight, and that they have an average particle diameter of 149 micrometers or less. When they have an average particle diameter of more than 149 micrometers, they are less likely to be uniformly dispersed in the matrix.

Graphite Powder in an amount of 0.20 to 2.1% by weight:

Likewise, the graphite powder can dissolve in the matrix of the present Fe-based sintered alloy as the carbon component to strengthen the matrix. Consequently, part of the graphite powder reacts with Fe or Mo in the matrix to form carbides, thereby improving the wear resistance. The graphite powder is added in the amount of 0.20 to 2.1% by weight. When the graphite powder is added in an amount of less than 0.20% by weight, no such advantages can be expected.

When the graphite powder is added in an amount of more than 2.1% by weight, such addition makes the resulting sintered alloys brittle. Accordingly, the graphite powder is added in the amount of 0.20 to 2.1% by weight, or it can be added in an amount of 0.30 to 1.7% by weight, depending on the application of the final products or the hard particles (or the Ni-based alloy powder later described) to be added. Preferably, the graphite powder is added in an amount of 0.40 to 1.7% by weight, and that it has an average particle diameter of 45 micrometers or less. When it has an average particle diameter of more than 45 micrometers, the carbon concentration is unpreferably unhomogeneous in the resulting matrices.

The present Fe-based sintered alloy is preferably produced by carrying out sintering at a temperature of 1,323 to 1,573 K. When carrying out sintering at a temperature of less than 1,323 K, the sintering is developed so insufficiently that the resulting sintered alloys lack the wear resistance. When carrying out sintering at a temperature of more than 1,573 K., the crystalline grains grow unpreferably coarse in the resulting sintered alloys.

In the modified present Fe-based sintered alloy, the matrix is modified to consist, percent by weight, essentially of 2.0 to 15% Co, 2.0 to 10% Mo, 0.20 to 2.0% C, 10% or less Ni, and the balance of Fe and inevitable impurities, thereby giving the present Fe-based sintered alloy superb corrosion resistance, oxidation resistance and wear resistance.

In the modified present Fe-based sintered alloy, depending on the applications thereof and the hard particles to be dispersed therein, the matrix can preferably include C in an amount of 0.20 to 2.0% by weight. C dissolves in the matrix so as to enhance it, and part of C diffuses into the hard particles or the Ni-based alloy powder to enlarge the hardness thereof, thereby improving the wear resistance of the present Fe-based sintered alloy. When the matrix includes C in an amount of less than 0.20%, no such advantages can be expected. When the matrix includes C in an amount of more than 2.0%, such addition makes the resulting sintered alloys brittle. Accordingly, the matrix preferably includes C in the amount of 0.20 to 2.0%.

In the modified present Fe-based sintered alloy, the hard particles (or the Ni-based alloy powder) to be dispersed in the matrix are novel, and they were developed by the present inventors. The hard particles consist, percent by weight, essentially of 20 to 75% Cr, 3.0 to 20% W, 0.50 to 5.0% C and the balance of Ni and inevitable impurities. Further, depending on the matrices to be combined therewith, the hard particles can further include at least one element selected from the group consisting of Si in an amount of 0.30 to 2.5%, Nb in an amount of 1.0 to 5.0% and Ti in an amount of 0.50 to 3.1%. Furthermore, it can further include Mo in an amount of 5.0 to 20%. Moreover, it can further include Fe in an amount of 5.0 to 30%.

Namely, Cr, W, Si, Nb, Ti, Mo and Fe of the hard particles react with C to form carbides, thereby improving the wear resistance of the present Fe-based sintered alloy, and Ni thereof diffuses into the matrix, thereby enhancing the oxidation resistance of the present Fe-based sintered alloy.

In addition, the modified present Fe-based sintered alloy can further include a free-machining additive dispersed therein in order to improve the machinability. Preferably, the free-machining additive can be at least one member selected from the group consisting of $CaF_2$, MnS and $MoS_2$, and it can be dispersed therein in an amount of 0.20 to 2.0% by weight. The free-machining additives can enhance the machinability of the modified present Fe-based sintered alloy while least deteriorating the improved wear resistance, corrosion resistance and oxidation resistance thereof.

When the free-machining additive is dispersed in the modified present Fe-based sintered alloy in an amount of less than 0.20% by weight, the machinability of the modified present Fe-based sintered alloy is enhanced insufficiently. When it is dispersed therein in an amount of more than 2.0%, the mechanical properties thereof are adversely affected. Therefore, it is dispersed therein in an amount of 0.20 to 2.0% by weight. Preferably, it is dispersed therein in an amount of 0.3 to 1.6% by weight, and that it has an average particle diameter of 200 micrometers or less. When it has an average particle diameter of more than 200 micrometers, the resulting Fe-based sintered alloys are brittle unpreferably.

In the production process of the modified present Fe-based sintered alloy, the present Fe-based alloy powder containing, percent by weight, 2.0 to 15% Co and 2.0 to 10% Mo is used and sintered to make the matrix. As a result, the alloying elements are dissolved in the matrix highly homogeneously, and accordingly the superb corrosion resistance, oxidation resistance and wear resistance can be given to the modified present Fe-based sintered alloy with the small contents of the alloying elements less than the conventional processes in which the ingredient element powders are mixed and used. In addition, the content ranges of the alloying elements are limited to fall in the aforementioned composition. Therefore, the compressibility is deteriorated less in the resulting raw material powder mixture. For instance, the compressibility exhibited in the present production process is equivalent to or slightly smaller than those exhibited in the conventional processes in which the ingredient element powders are mixed and used. Accordingly, the modified present Fe-based sintered alloy cannot be adversely affected in terms of the oxidation resistance, the corrosion resistance, and the like, associated with the compressibility Or the density.

Moreover, in the production process of the modified present Fe-based sintered alloy, it is necessary to carry out the sintering at a temperature of from 1,323 K. to a melting point or less of the Ni-based alloy powder (or the hard particles), preferably from 1,323 to 1,473 K., in an non-oxidizing atmosphere for 900 to 7,200 seconds. When the sintering is carried out at a temperature of less than 1,323 K., the sintering develops inadequately so that resulting matrices come to have insufficient strength, and that binding forces come to be improperly exerted between the hard pard particles and the resulting matrices. When the sintering is carried out at a temperature of more than the melting point of the Ni-based alloy powder, the resulting hard particles lose the wear resistance. Namely, when the sintering is carried out in the temperature range for 900 to 7,200 seconds, part of the Ni elements in the Ni-based alloy powder diffuse into the matrix to improve the heat resistance of the matrix, and the binding between the hard particles and the matrix is enhanced so that the hard particles are less likely to come off from the matrix.

As described above, in the production process of the modified present Fe-based sintered alloy, the Ni-based alloy powder (or the hard particles) was developed by the present inventors, and it consists, percent by weight, 20 to 75% Cr, 3.0 to 20% W, and the balance of Ni and inevitable impurities. Further, it can further include either Mo in an amount of 5.0 to 20%, Fe in an amount of 10 to 30%, or at least one element selected from the group consisting of Si in an amount of 0.30 to 2.0%, Nb in an amount of 1.0 to 4.0% and Ti in an amount of 0.50 to 2.5%.

Namely, Cr, W, Mo, Fe, Si Nb and Ti of the Ni-based alloy powder react with C to form carbides, thereby contributing to improving the wear resistance of the present Fe-based sintered alloy, and Ni thereof diffuses into the matrix, thereby contributing to enhancing the oxidation resistance of the present Fe-based sintered alloy. However, when Ni is alloyed into the Fe-Co-Mo alloy powder in advance, the compressibility of the resulting alloys degrades. On the other hand, in the present production process, Ni of the Ni-based alloy powder diffuses into the matrix of the Fe-Co-Mo alloy during the sintering, thereby improving the oxidation resistance of the present Fe-based sintered alloy. Hence, in accordance with the present production process, it is unnecessary to alloy Ni into the Fe-Co-Mo alloy powder beforehand.

In particular, the advantages associated with the addition of Mo are appreciable when Mo is preferably added in an amount of more than 3% (not inclusive) and up to 10%.

In addition, in the production process of the modified present Fe-based sintered alloy, the Ni-based alloy powder (or the hard particles) can further include C in an amount of 0.50 to 4.0%. C dissolves in the Fe-based alloy powder to form carbides with Fe and Mo, thereby enlarging the hardness of the matrix. Accordingly, the modified present Fe-based sintered alloy is enhanced in the wear resistance. When the Ni-based alloy powder includes C in an amount of less than 0.50%, no such advantages can be expected. When it includes C in an amount of more than 4.0%, such addition makes the resulting sintered alloys brittle. Accordingly, the Ni-based alloy powder preferably includes C in the amount of 0.50 to 4.0%.

Likewise, in the production process of the modified present Fe-based sintered alloy, the graphite powder is adapted to be added to the mixed powder of the Fe-Co-Mo alloy powder and the Ni-based alloy powder in the amount of 0.20 to 2.1% due to the reasons set forth above.

Moreover, also in the production process of the modified present Fe-based sintered alloy, when preparing the green compact, at least one of the aforementioned free-machining additives can be further mixed in the amount of 0.20 to 2.0% by weight in order to improve the machinability of the modified present Fe-based sintered alloy.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
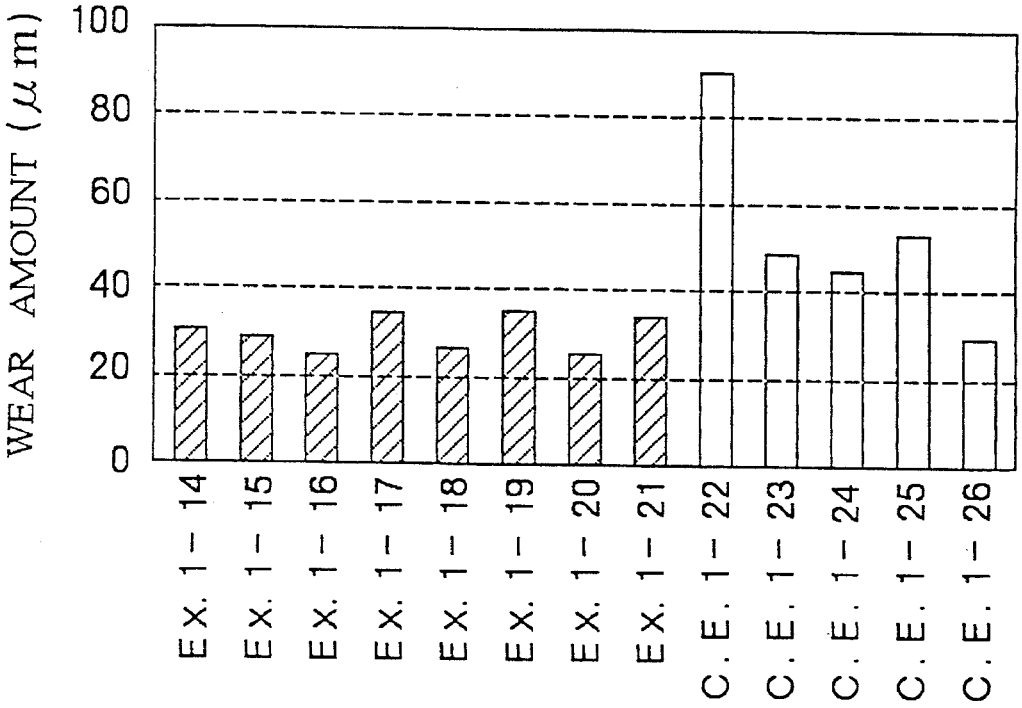
FIG. 1 is a bar chart illustrating the wear amounts exhibited by the First Preferred Embodiments of the present invention and the Comparative Examples.

Having generally described the present invention, a further understanding can be obtained by reference to the specific preferred embodiments which are provided herein for purposes of illustration only and are not intended to limit the scope of the appended claims.

First Preferred Embodiments

Examples 1-1 through 1-6

Alloys having the compositions identified with Examples 1-1 through 1-5 and Comparative Examples 1-7 through 1-11 in Table 1 were melted and atomized to prepare alloy powders. Then, each of the alloy powders were reduced, pulverized and classified to prepare alloy powders having an average particle diameter of 150 micrometers or less.

Examples 1-1 through 1-5 were the First Preferred Embodiments of the present invention, and they included Co and Mo falling in the present content ranges recited in the appended claims.

In Comparative Examples 1-7 through 1-11, Comparative Example 1-7 included Co less than the lower limit of the present content range. Comparative Example 1-8 included Mo less than the lower limit of the present content range. Comparative Example 1-9 included Mo more than the upper limit of the present content range. Comparative Example 1-10 included O more than the Examples. Comparative Example 1-11 included C more than the Examples.

In particular, Example 1-6 was also one of the First Preferred Embodiments of the present invention. It was prepared as follows: First, an atomized Fe-9%Mo alloy was prepared. Then, the atomized alloy powder was subjected to the diffusion treatment to diffuse Co into it and include Co in an amount set forth in Table 1. Example 1-6 was a partly alloyed powder, and it had an average particle diameter of 150 micrometers or less.

TABLE 1

| Identi- | Chemical Components (% by weight) | | | | | Powder | Compressi- bility | Corrosion Weight Loss |
|---|---|---|---|---|---|---|---|---|
| fication | Co | Mo | O | C | Fe | Form | ($g/cm^3$) | ($g/cm^3$) |
| Ex. 1-1 | 2.5 | 6.1 | 0.07 | 0.03 | Balance | Alloy | 6.95 | −0.808 |
| Ex. 1-2 | 6.0 | 5.9 | 0.06 | 0.04 | Balance | Alloy | 6.93 | −0.763 |
| Ex. 1-3 | 14.2 | 5.9 | 0.05 | 0.04 | Balance | Alloy | 6.90 | −0.727 |
| Ex. 1-4 | 6.1 | 2.4 | 0.05 | 0.04 | Balance | Alloy | 7.02 | −0.832 |
| Ex. 1-5 | 6.0 | 8.9 | 0.06 | 0.04 | Balance | Alloy | 6.82 | −0.645 |
| Ex. 1-6 | 6.1 | 9.0 | 0.06 | 0.04 | Balance | Partly Alloyed | 6.80 | −0.712 |
| C.E. 1-7 | 1.2 | 6.0 | 0.06 | 0.04 | Balance | Alloy | 6.91 | −0.896 |
| C.E. 1-8 | 6.0 | 1.3 | 0.05 | 0.03 | Balance | Alloy | 7.05 | −0.963 |
| C.E. 1-9 | 5.9 | 12.2 | 0.06 | 0.05 | Balance | Alloy | 6.35 | −0.629 |
| C.E. 1-10 | 6.1 | 6.2 | 0.35 | 0.06 | Balance | Alloy | 6.42 | |
| C.E. 1-11 | 6.2 | 6.0 | 0.06 | 0.23 | Balance | Alloy | 6.38 | |
| C.E. 1-12 | 14.0 | 6.0 | 0.10 | 0.01 | Balance | Mixed | 6.92 | −1.047 |
| C.E. 1-13 | 6.0 | 9.0 | 0.10 | 0.01 | Balance | Mixed | 6.85 | −1.205 |

Comparative Examples 1-12 and 1-13 were prepared by mixing their ingredient element powders. Namely, they were prepared as follows: First, commercially available pure iron, cobalt and molybdenum powders were prepared, and they had an average particle diameter of 45 micrometers or less. Then, they were weighed so as to make the compositions recited in Table 1, and they were mixed with a "V"-mixer.

The resulting powders adapted for sintering were examined for their compressibility and corrosion resistance. The compressibility of the powders was evaluated as follows: A mold having a diameter of 11.3 mm was prepared. After coating the mold with a lubricant and charging each of the powders in the mold, the powders were subjected to a forming pressure of 588 MPa to prepare green compacts. Finally, the density of the green compacts were measured.

The corrosion resistance of the sintered bodies made of the powders was evaluated as follows: After forming the powders into green compacts having a density of 6.9 $g/cm^3$, they were left at a temperature of 1,400 K. for 1.8 Ks in a nitrogen atmosphere, and they were cooled at a rate of 20°–30° C./min., thereby preparing test specimens. The test specimens were immersed into a mixed reagent containing lead oxide and lead sulfate, and they were heated at a temperature of 1,108 K. for 3.6 Ks. Then, the test specimens were examined for their weight loss. Comparative Examples 1-10 and 1-11 were not examined for their corrosion resistance. The results of the examinations are summarized in Table 1.

As set forth in Table 1, Comparative Example 1-7 exhibited good compressibility, but it exhibited poorer corrosion resistance than the Examples because its Co content was as small as 1.2%. Comparative Example 1-8 also exhibited good compressibility, but it also exhibited poorer corrosion resistance than the Examples because its Mo content was as small as 1.3%. Comparative Example 1-9 exhibited small weight loss, but it exhibited poorer compressibility than the Examples because its Mo content was as large as 12.2%. Comparative Example 1-10 and 1-11 exhibited poorer compressibility than the Examples because their O or C content was large.

In Comparative Examples 1-12 and 1-13 employing the ingredient element powders, the alloying elements diffused into their matrices during the sintering, but they were hardly diffused completely. Accordingly, even when the alloying elements were added in the larger amounts, there arose the portions which showed the low solid solution rate. The corrosion and oxidation occurred starting at these portions selectively, accordingly Comparative Examples 1-12 and 1-13 exhibited remarkably poorer corrosion resistance than the Examples. For example, although Comparative Example 1-12 and Example 1-3 had the same composition substantially, Comparative Example 1-12 exhibited the remarkably large corrosion weight loss of 1.047 $g/cm^3$, whereas Example 1-3 exhibited the small corrosion weight loss of 0.727 $g/cm^3$.

On the other hand, in Examples 1-1 through 1-6, the alloying elements were alloyed in advance. Therefore, they were superb in the solid solution homogenizing, thereby producing the maximum addition effects of the alloying elements. For instance, they exhibited the corrosion weight loss of 0.645–0.832 $g/cm^3$. Thus, they were verified to exhibit the excellent corrosion resistance and oxidation resistance with the small addition amounts of the alloying elements.

Regarding the compressibility of the powders, Examples 1-1 through 1-6 exhibited the compressibility which was deteriorated only by a small factor because their addition amounts of the alloying elements were regulated within the predetermined ranges. For example, Comparative Examples 1-12 and 1-13 employing the ingredient element powders exhibited the compressibility of 6.85–6 92 $g/cm^3$ whereas the Examples exhibited the compressibility of 6.80–7.02 $g/cm^3$ which was substantially equal to those exhibited by Comparative Examples 1-12 and 1-13.

Examples 1-14 through 1-21

Atomized alloy powders having the compositions, which included Co, Mo and the balance of Fe and inevitable impurities and were identified with Examples 1-14 through 1-21 and Comparative Examples 1-22 through 1-26 in Table 2, were prepared in advance, and they had an average particle diameter of 177 micrometers or less. Then, a graphite powder (e.g., a natural graphite powder abbreviated to "Gr." in Table 2) was weighed by the contents set forth in Table 2, and a zinc stearate lubricant was also weighed by 1.0% by weight of the sum of the atomized alloy powders and the graphite powder. The graphite powder had an average particle diameter of 40 micrometers or less. Each of the atomized alloy powders were mixed with the graphite powder and the lubricant by using a "V" mixer.

Thereafter, a forming pressure was adjusted so as to prepare green compacts having a density of 7.0 $g/cm^3$. Then, the green compacts were sintered to prepare test specimens at sintering temperatures (K.) set forth in Table 2 in a nitrogen atmosphere.

TABLE 2

| Identification | Chem. Components or Contents (% by w.) Co | Mo | Fe | FeMo | Gr. (% by weight) | Sintering Temp. (K.) | Powder Used |
|---|---|---|---|---|---|---|---|
| Ex. 1-14 | 3.1 | 6.5 | Balance | — | 0.9 | 1403 | Fe—Co—Mo Alloy |
| Ex. 1-15 | 8.2 | 5.9 | Balance | — | 0.9 | 1403 | " |
| Ex. 1-16 | 13.8 | 6.1 | Balance | — | 0.9 | 1403 | " |
| Ex. 1-17 | 8.1 | 2.3 | Balance | — | 0.9 | 1403 | " |
| Ex. 1-18 | 8.2 | 9.1 | Balance | — | 0.9 | 1403 | " |
| Ex. 1-19 | 8.2 | 5.9 | Balance | — | 0.4 | 1403 | " |
| Ex. 1-20 | 6.0 | 4.2 | Balance | — | 1.7 | 1403 | " |
| Ex. 1-21 | 8.2 | 5.9 | Balance | — | 0.9 | 1523 | " |
| C.E. 1-22 | 8.0 | 6.0 | Balance | — | 0.9 | 1403 | Ingredient Elements |
| C.E. 1-23 | 8.0 | 6.0 | Balance | 7.0 | 0.9 | 1403 | Ingredient Elements |
| C.E. 1-24 | 1.2 | 6.0 | Balance | — | 0.9 | 1403 | Fe—Co—Mo Alloy |
| C.E. 1-25 | 6.0 | 1.3 | Balance | — | 0.9 | 1403 | " |
| C.E. 1-26 | 5.9 | 12.2 | Balance | — | 0.9 | 1403 | " |

Examples 1-14 through 1-21 were the First Preferred Embodiments of the present invention, and they included Co, Mo and the graphite powder falling in the present content ranges recited in the appended claims.

In Comparative Examples 1-24 through 1-26, Comparative Example 1-24 included Co less than the lower limit of the present content range. Comparative Example 1-25 included Mo less than the lower limit of the present content range. Comparative Example 1-26 included Mo more than the upper limit of the present content range.

In particular, Comparative Examples 1-22 and 1-23 employed the ingredient element powders. Namely, they were prepared as follows: First, atomized iron, cobalt, molybdenum, FeMo and graphite powders were prepared, and they were weighed so as to make the compositions set forth in Table 2. Likewise, they were mixed and formed to prepare green compacts. Then, the green compacts were sintered to prepare test specimens at a sintering temperature (K.) set forth in Table 2 in a nitrogen atmosphere.

When preparing the green compacts, both of the Examples and the Comparative Examples (except Comparative Example No. 1-26) could be prepared at forming pressures of 5–7 Ton/cm$^2$. However, when preparing the green compacts with Comparative Example No. 1-26, it was necessary to apply a forming pressure of 10 Ton/cm$^2$ or more. Thus, considering the longevity of mold, Comparative Example No. 1-26 was found to be impractical.

When using Fe-Co-Mo alloy powders, for example, when preparing Example 1-14, 99.1% of an Fe-3.1% Co-6.5% Mo alloy powder and 0.9% of the graphite powder were used in total of 100%, and 1.0% of the zinc stearate lubricant was further added to and mixed with the mixture.

When using the ingredient element powders, for example, when preparing Comparative Example 1-22, 8.0% of the Co powder, 6.0% of the Mo powder, 0.9% of the graphite powder and 85.1% of the Fe powder were used in total of 100%, and 1.0% of the zinc stearate lubricant was further added to and mixed with the mixture.

The sintered bodies (i.e., test specimens) prepared in accordance with the compositions set forth in Table 2 were subjected to a wear test to evaluate their wear resistance.

The wear test was carried out as follows: The sintered bodies were processed into valve seats having a ring shape having an inside diameter of 23 mm, an outside diameter of 29 mm and a thickness of 6.5 mm, and the valve seats were tested on a valve and valve seat testing apparatus simulating an actual engine. In the testing apparatus, the valves and the valve seats were heated by combusting a propane gas, and the valves were opened and closed by operating cams. Thus, the testing apparatus is adapted to simulate the hitting wear between the valves and the valve seats.

In the wear test, the valves were made of SUH3 as per JIS (Japanese Industrial Standard), and the temperatures of the valves and the valve seats were controlled and kept at 1,023 K. and 673 K., respectively. The cams were operated at a speed of 2,000 rpm for a running time of 28.8 Ks. Then, the valve seats were examined for their wear amounts. The results of this test are illustrated in FIG. 1.

As illustrated in FIG. 1, the valve seats made of Comparative Example 1-22 employing the mixed ingredient element powders were worn most to exhibit a wear amount of 89 micrometers. Although Comparative Example 1-22 had the same composition as that of Example 1-15 substantially, the wear amount was as much as about 3 times of the wear amount exhibited by the valve seats made of Example 1-15. It is believed that the hardness variations associated with the structural differences have resulted in the wear resistance differences. For example, the valve seats made of Example 1-15 had the matrix structure of bainite, whereas the valve seats made of Comparative Example 1-22 had the matrix structure of pearlite mainly. Consequently, when comparing the apparent hardnesses, the valve seats made of Comparative Example 1-22 exhibited about a half of the hardness exhibited by those made of Example 1-15.

Likewise, Comparative Example 1-23 included the FeMo intermetallic compound as hard particles in addition to the same ingredient element powders of Comparative Example 1-22. The valve seats made of Comparative Example 1-23 exhibited a wear amount of 50 micrometers which was improved over the wear amount exhibited by those made of Comparative Example 1-22. However, the wear amount was inferior to the wear amounts exhibited by the Examples.

Further, the valve seats made of Comparative Example including Co in the lesser amount of 1.2%, and those made of Comparative Example 1-25 including Mo in the lesser amount of 1.3% exhibited a wear amount of 45 to 52 micrometers, and they were inferior in the wear resistance. The valve seats made of Comparative Example 1-26 including Mo in the larger amount of 12.2% exhibited a wear amount of 30 micrometers, and they were good in the wear resistance. However, as mentioned earlier, Comparative Example 1-26 exhibited the poor compressibility, and accordingly the valve seats made thereof were not improved in the density sufficiently.

On the other hand, in the valve seats made of Examples 1-14 through 1-21, the alloying elements were diffused into the matrix structures to effect the solid solution homogenizing, thereby making the matrix structures into bainite. As a result, the valve seats made of the Examples exhibited a superb wear amount of 25 to 35 micrometers, and they were thus verified to be remarkably improved in the wear resistance.

Examples 1-27 through 1-37

Atomized alloy powders including Co, No and the balance of Fe and inevitable impurities and having the compositions identified with Examples 1-27 through 1-37 and Comparative Examples 1-38 through 1-40 in Table 3 were prepared in advance, and they had an average particle diameter of 177 micrometers or less. Also, infiltrating alloy powders 1-A, 1-B and 1-C were prepared in advance. The infiltrating alloy powder 1-A included Pb, the infiltrating alloy powder 1-B included Pb in an amount of 30% and the balance of Cu, and the infiltrating alloy powder 1-C included Cu. Then, a graphite powder (e.g., a natural graphite powder abbreviated to "Gr." in Table 3) was weighed by the contents set forth in Table 3, and a zinc stearate lubricant was also weighed by 1.0% by weight of the sum of the atomized alloy powders and the graphite powder. The graphite powder had an average particle diameter of 40 micrometers or less. Each of the atomized alloy powders were mixed with the graphite powder and the lubricant by using a "V" mixer.

Thereafter, a forming pressure was adjusted so as to prepare green compacts having a density of 7.0 g/cm$^3$. Then, the green compacts left at a sintering temperature of 1,403 K. in a nitrogen atmosphere, and sintering was carried out to prepare test specimens. Finally, the test specimens were subjected to the infiltration which was carried out at the same temperature and in the same atmosphere as the sintering.

In Table 3, Examples 1-27 through 1-37 were the First Preferred Embodiments of the present invention.

In Comparative Examples 1-38 through 1-40, Comparative Example 1-B8 was not at all subjected to the infiltration utilizing the infiltrating alloy powders. Comparative Example 1-39 included Co less than the lower limit of the present content range. Comparative Example 1-40 was subjected to the infiltration utilizing the infiltrating alloy powder 1-A in an amount smaller than the lower limit of the infiltration range.

TABLE 3

| Identification | Chemical Components (% by weight) | | | | Infiltrating Alloy (% by w.) | | | Wear Dent Width |
|---|---|---|---|---|---|---|---|---|
| | Co | Mo | Fe | Gr. | 1-A | 1-B | 1-C | (mm) |
| Ex. 1-27 | 2.3 | 6.1 | Balance | 0.9 | 14 | 0 | 0 | 1.7 |
| Ex. 1-28 | 3.2 | 6.1 | Balance | 0.9 | 14 | 0 | 0 | 1.7 |
| Ex. 1-29 | 7.5 | 6.0 | Balance | 0.9 | 14 | 0 | 0 | 1.6 |
| Ex. 1-30 | 13.1 | 6.2 | Balance | 0.9 | 14 | 0 | 0 | 1.5 |
| Ex. 1-31 | 7.7 | 3.9 | Balance | 0.9 | 14 | 0 | 0 | 1.7 |
| Ex. 1-32 | 7.5 | 8.6 | Balance | 0.9 | 14 | 0 | 0 | 1.4 |
| Ex. 1-33 | 7.5 | 6.0 | Balance | 0.4 | 14 | 0 | 0 | 1.7 |
| Ex. 1-34 | 7.5 | 6.0 | Balance | 1.7 | 14 | 0 | 0 | 1.4 |
| Ex. 1-35 | 7.5 | 6.0 | Balance | 0.9 | 0 | 14 | 0 | 1.7 |
| Ex. 1-36 | 7.5 | 6.0 | Balance | 0.9 | 0 | 0 | 14 | 1.9 |
| Ex. 1-37 | 7.5 | 6.0 | Balance | 0.9 | 7 | 0 | 0 | 1.7 |
| C.E. 1-38 | 7.5 | 6.0 | Balance | 0.9 | 0 | 0 | 0 | 2.3 |
| C.E. 1-39 | 1.7 | 5.9 | Balance | 0.9 | 14 | 0 | 0 | 2.1 |
| C.E. 1-40 | 7.5 | 6.0 | Balance | 0.9 | 2 | 0 | 0 | 2.2 |

The resulting sintered bodies (i.e., test specimens) made of the Examples and Comparative Examples were subjected to the "OHKOSHI" type wear test, and they were examined for their wear resistance whether they were applicable to valve seats. In the "OHKOSHI" type wear test, the sintered bodies were processed into block-shaped test specimens having a length of 45 mm, a width of 28 mm and a thickness of 6.0 mm, and mating members (e.g., rotors) were made of SUH11 as per JIS. The blocks were examined for the wear resistance on the "OHKOSHI" type wear testing apparatus under the following testing conditions. The wear resistance was evaluated in terms of the wear dent width on the blocks, and the results are summarized in Table 3 as well.

(Testing Conditions of "OHKOSHI" type Wear Test).

Mating Member (e.g., Rotor): Made of SUH11 as per JIS, and having an inside diameter of 16 mm, an outside diameter of 30 mm and a thickness of 11 mm;

Block: Made of Examples 1-27 through 1-37, and Comparative Examples 1-38 through 1-40;

Sliding Speed: 0.51 m/s;

Wear Distance: 100 m;

Final Load: 31.5 N;

Temperature: Room Temperature

Evaluated Characteristic: Width of Wear Dent on Block

As can be understood from Table 3, the blocks made of Comparative Example 1-38, not subjected to the infiltration at all, and those made of Comparative Example 1-40, subjected to the infiltration utilizing the infiltrating alloy powder 1-A in the smaller amount, exhibited a large wear dent width of 2.3 and 2.2 mm, respectively. The blocks made of Comparative Example 1-39, included Co in the small amount, exhibited a large wear dent width of 2.1 mm. The blocks made of the Comparative Examples were thus inferior in the wear resistance.

On the other hand, the blocks made of Examples 1-27 through 1-37, subjected to the infiltration utilizing either of the infiltrating alloy powders 1-A, 1-B or 1-C in the amount of 14%, exhibited a small wear dent width of 1.4 to 1.9 mm, because the infiltrating alloys were interposed between the contact areas and they acted as a lubricant. The blocks made of the Examples were thus verified to be enhanced in the wear resistance and the seizure resistance.

Example 1-41

An Fe-based alloy powder having an average particle diameter of 177 micrometers or less was prepared by atomizing, and it included the alloying elements of 3.3% Mo, 6.1% Co, 0.040% 0, 0.030% C. and the balance of Fe and inevitable impurities. The resulting alloy powder (i.e., Example 1-41) adapted for sintering was examined for the compressibility, and a sintered body was made of the alloy powder and examined for the corrosion resistance.

The compressibility of Example No. 1-41 was evaluated in the same manner as Examples 1-1 through 1-6 were evaluated. The corrosion resistance of the sintered body made of Example No. 1-41 was also evaluated in the same manner as the sintered bodies made of Examples 1-1 through 1-6 were evaluated.

According to the evaluations, the green compact made of Example 1-41 exhibited a density of 6.98 g/cm$^3$, which was indeed equal to the compressibility exhibited by those made of Examples 1-1 through 1-6 listed in Table 1. The sintered body made of Example 1-41 exhibited the weight loss of 0.790 g/cm$^3$ due to the corrosion, and the value was comparable with the values exhibited by those made of Examples 1-1 through 1-6 listed in Table 1.

Example 1-42

An Fe-based alloy powder having an average particle diameter of 177 micrometers or less was prepared by atomizing, and it included the alloying elements of 3.2% Mo, 8.1% Co and the balance of Fe and inevitable impurities. Then, a commercially available graphite powder was weighed by a content of 0.9%, and a lubricant was also weighed by 1.0% by weight of the sum of the atomized Fe-based alloy powder and the graphite powder. The atomized Fe-based alloy powder (i.e., Example 1- 42) was mixed with the graphite powder and the lubricant by using a "V" mixer. Thereafter, the resulting mixture was formed into a green compact, and the green compact was sintered to prepare test specimens. The forming and sintering were carried out in the same manner as Examples 1-14 through 1-21 were formed and sintered except that the sintering temperature was fixed at 1,403 K.

The sintered bodies (i.e., test specimens) thus prepared were subjected to the wear test, to which the sintered bodies made of Examples 1-14 through 1-21 were subjected, to evaluate their wear resistance.

As a result, the valve seats made of Example 1-42 exhibited a wear amount of 29 micrometers. Comparing this result with the wear amounts exhibited by those made of Examples 1-14 through 1-21 and illustrated in FIG. 1, it was found to be substantially equivalent to them.

Second Preferred Embodiments

Examples 2-1 through 2-7

The following raw materials were prepared in order to produce Examples 2-1 through 2-7 of the Second Preferred Embodiments of the present invention:

an Fe-based atomized alloy powder 2-A including, percent by weight, 2.2% Mo, 6.0% Co and substantially the balance of Fe, and having an average particle diameter of 177 micrometers or less;

an Fe-based atomized alloy powder 2-E including, percent by weight, 2.3% Mo, 6.0% Co and substantially the balance of Fe, and having an average particle diameter of 177 micrometers or less;

an Fe-based atomized alloy powder 2-F including, percent by weight, 3.2% Mo, 5.9% Co and substantially the balance of Fe, and having an average particle diameter of 177 micrometers or less;

an Ni-based atomized alloy powder 2-B including, percent by weight, 35.2% Cr, 14.4% W, 10.3% Mo and substantially the balance of Ni, and having an average particle diameter of 149 micrometers or less;

an Ni-based atomized alloy powder 2-C including, percent by weight, 33.7% Cr, 16.5% W, 12.1% Mo, 2.7% C. and substantially the balance of Ni, and having an average particle diameter of 149 micrometers or less;

a graphite powder; and a zinc stearate lubricant.

The raw materials were weighed by the contents set forth in Table 4 so as to make the compositions recited therein. Then, each of the resulting mixtures was formed into a green compact having a density of 6.9 g/cm$^3$.

In order to produce Comparative Examples 2-8 through 2-10, an atomized Fe powder, a Co powder, an Mo powder, an Ni powder, an FeMo powder, an Fe-based atomized alloy powder 2-D including, percent by weight, 1.5% Mo, 5.8% Co and substantially the balance of Fe, and having an average particle diameter of 117 micrometers or less, a commercially available 1% Cr-0.7% Mn-0.3% Mo alloy powder 2-G (e.g., "KIP4100VS" alloy powder produced by KAWASAKI SEITETSU CO., LTD.) having an average particle diameter of 177 micrometers or less, a graphite powder and a zinc stearate lubricant were prepared and weighed by the contents set forth in Table 4 so as to make the compositions recited therein. Then, each of the resulting mixtures was formed into a green compact having a density of 6.9 g/cm$^3$.

TABLE 4

| Identification | Major Raw Mat. | Alloy 2-B | Alloy 2-C | Co Powder | Mo Powder | Ni powder | FeMo Powder | Graphite | Luburicant |
|---|---|---|---|---|---|---|---|---|---|
| Ex. 2-1 | 2-A | 5 | — | — | — | — | — | 0.8 | 0.9 |
| Ex. 2-2 | " | 15 | — | — | — | — | — | 0.8 | 0.9 |
| Ex. 2-3 | " | 25 | — | — | — | — | — | 0.8 | 0.9 |
| Ex. 2-4 | " | — | 10 | — | — | — | — | 0.8 | 0.9 |

TABLE 4-continued

| Identification | Major Raw Mat. | Alloy 2-B | Alloy 2-C | Co Powder | Mo Powder | Ni powder | FeMo Powder | Graphite | Luburicant |
|---|---|---|---|---|---|---|---|---|---|
| Ex. 2-5 | " | 15 | — | — | — | — | — | 1.4 | 0.9 |
| Ex. 2-6 | 2-E | 15 | — | — | — | — | — | 0.8 | 0.9 |
| Ex. 2-7 | 2-F | 15 | — | — | — | — | — | 0.8 | 0.9 |
| C.E. 2-8 | Fe | — | — | 9 | 4 | 9 | 15 | 0.6 | 0.9 |
| C.E. 2-9 | 2-D | 15 | — | — | — | — | — | 0.6 | 0.9 |
| C.E. 2-10 | 2-G | — | — | — | — | — | — | 0.6 | 0.9 |

The green compacts made of Examples 2-1 through 2-7 and Comparative Examples 2-8 through 2-10 were sintered at a temperature of 1,393 K. in a decomposed ammonia gas atmosphere for 1.8 Ks. Sintered bodies made of Examples 2-1 through 2-7 and Comparative Examples 2-8 through 2-10 were thus produced.

The resulting sintered bodies made of Examples 2-1 through 2-7 and Comparative Examples 2-8 through 2-10 were subjected to the "OHKOSHI" type wear test in the same manner as Examples 1-27 through 1-37, and they were examined for their wear resistance. However, among the testing conditions, the mating member was made of SUH 35 as per JIS instead of SUH11, the temperatures of the rotor (i.e., the mating member) and the blocks were kept at 773 K. and 693 K. instead of room temperature. In particular, in this "OHKOSHI" type wear test, the wear amounts of the blocks were evaluated in terms of the wear volume of the blocks.

Evaluated Characteristics: Wear Amounts of Valve Seats and Valves

The following can be understood from Table 5: Despite the large contents of the alloying elements, the blocks made of Comparative Example 2-8, employing the alloying ingredient element powders, exhibited a wear volume of $72\times10^{-3}$ $mm^3$, because the alloying elements were dissolved in the matrix inhomogeneously. The blocks made of Comparative Example 2-9, included Mo in the amount of 2.8%, exhibited a wear volume of $69\times10^{-3}$ $mm^3$. The blocks made of Comparative Example 2-10, employing the commercially available raw material powder adapted for producing wear resistant sintered alloys, exhibited a wear volume of $158\times10^{-3}$ $mm^3$.

On the other hand, the blocks made of Examples 2-1 through 2-7 exhibited a wear volume of $41\times10^{-3}$ to $54\times10^{-3}$ $mm^3$, because the Examples employed the novel Fe-based alloy powders with the novel Ni-based hard alloy powders dispersed therein. Thus, the blocks made of the Examples were found to be superb in the wear resistance, and accordingly the advantageous effects of the present invention were verified.

TABLE 5

| Identification | Chemical Components (% by weight) | | | | | | | | "OHKOSHI" Wear Volume |
|---|---|---|---|---|---|---|---|---|---|
| | Co | Mo | Ni | Cr | W | Mn | C | Fe | ($10^{-3}$ $mm^3$) |
| Ex. 2-1 | 5.7 | 4.5 | 2.0 | 1.7 | 0.7 | — | 0.7 | Balance | 52 |
| Ex. 2-2 | 5.1 | 5.0 | 5.9 | 5.2 | 2.0 | — | 0.7 | Balance | 46 |
| Ex. 2-3 | 4.4 | 5.8 | 10.1 | 8.6 | 3.5 | — | 0.7 | Balance | 41 |
| Ex. 2-4 | 5.4 | 4.9 | 3.5 | 3.4 | 1.6 | — | 1.0 | Balance | 43 |
| Ex. 2-5 | 5.0 | 5.0 | 6.0 | 5.2 | 2.1 | — | 1.3 | Balance | 42 |
| Ex. 2-6 | 5.1 | 3.4 | 5.9 | 5.3 | 2.1 | — | 0.7 | Balance | 54 |
| Ex. 2-7 | 5.0 | 4.2 | 5.9 | 5.3 | 2.0 | — | 0.7 | Balance | 48 |
| C.E. 2-8 | 8.8 | 13.1 | 9.1 | — | — | — | 0.6 | Balance | 72 |
| C.E. 2-9 | 4.9 | 2.8 | 6.0 | 5.2 | 2.1 | — | 0.7 | Balance | 69 |
| C.E. 2-10 | — | 0.28 | — | 0.98 | — | 0.71 | 0.7 | Balance | 158 |

Figure 2:
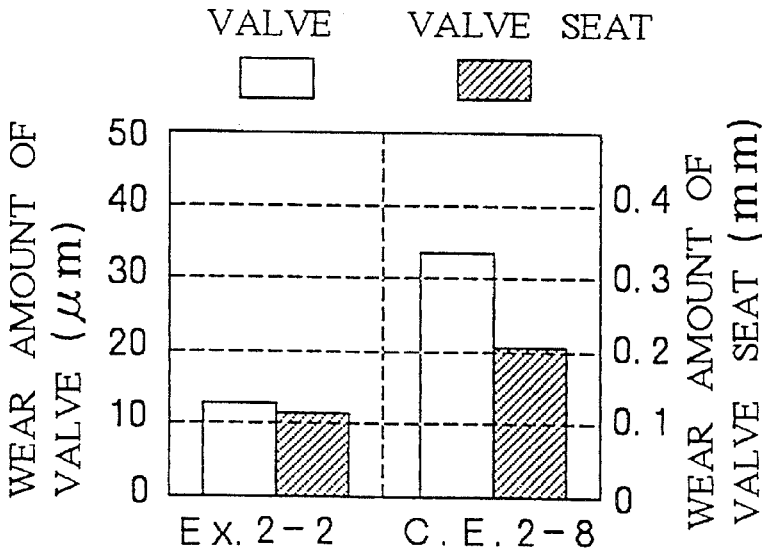
FIG. 2 is a bar chart illustrating the wear amounts exhibited by valves and valve seats examined for the durability on an actual engine, valve seats which were made of the Second Preferred Embodiments of the present invention and the Comparative Examples.

In addition, the sintered bodies made of Example 2-2 and Comparative Example 2-8 were tested for their durability on an actual engine. Thus, the sintered bodies were evaluated whether they were applicable to valve seats. Table 5 summarizes the results of the wear resistance evaluation along with the whole chemical compositions of Examples 2-1 through 2-7 and Comparative Examples 2-8 through 2-10. FIG. 2 illustrates the wear amounts exhibited by the valves and the valve seats made of Example 2-2 and Comparative Example 2-8 during the durability test on actual engine.

The conditions of the durability test on actual engine were set forth below:

Engine: U-cylinder, 2,000 c.c.-displacement;

Running Conditions: 6,000 rpm for 648 Ks at Full Load;

Cooling Water Temperature: 383 K.

Valve Seat: Made of Examples 2-2, and Comparative Example 2-8;

Valve: SUH35 as per JIS, and Facing made of Stellite No. 6 Building-up Alloy;

As can be appreciated from FIG. 2, the valves and the valve seats made of Example 2-2 were worn about half as little as were the valves and the valve seats made of Comparative Example 2-8 in the durability test on actual engine. Hence, the Fe-based sintered alloys of the present invention were verified to be applicable to the valve seats.

Examples 2-11 through 2-16

The following raw materials were prepared in order to produce Examples 2-11 through 2-16 of the Second Preferred Embodiments of the present invention:

an Fe-based atomized alloy powder 2-H including, percent by weight, 6.3% Mo, 4.2% Co and substantially the balance of Fe, and having an average particle diameter of 177 micrometers or less;

an Ni-based atomized alloy powder 2-I including, percent by weight, 14.4% W, 35.2% Cr, 10.3% Mo and substantially the balance of Ni, and having an average particle diameter of 149 micrometers or less;

a commercially available graphite powder;

free-machining additives, e.g., $CaF_2$, $MoS_2$ and MnS powders; and a zinc stearate lubricant.

The raw materials were weighed by the contents set forth in Table 6 so as to make the compositions recited therein. Then, each of the resulting mixtures was formed into a green compact having a density of 6.9 g/cm$^3$.

TABLE 6

| Identification | Component Powder (% by weight) | | | | | |
|---|---|---|---|---|---|---|
| | 2-H | 2-I | $CaF_2$ | $MoS_2$ | MnS | Graphite |
| Ex. 2-11 | Balance | 8 | 1.0 | — | — | 1.0 |
| Ex. 2-12 | Balance | 15 | 1.0 | — | — | 1.0 |
| Ex. 2-13 | Balance | 8 | — | 1.0 | — | 1.0 |
| Ex. 2-14 | Balance | 8 | — | — | 1.0 | 1.0 |
| Ex. 2-15 | Balance | 8 | — | 0.3 | — | 1.0 |
| Ex. 2-16 | Balance | 8 | — | 1.6 | — | 1.0 |
| C.E. 2-17 | Balance | 8 | — | — | — | 1.0 |
| C.E. 2-18 | Balance | 8 | — | 0.1 | — | 1.0 |
| C.E. 2-19 | Balance | 8 | — | 2.5 | — | 1.0 |

Likewise, in order to produce Comparative Examples 2-17 through 2-19, the aforementioned raw materials were weighed by the contents set forth in Table 6 so as to make the compositions recited therein. Then, each of the resulting mixtures was formed into a green compact having a density of 6.9 g/cm$^3$. In particular, Comparative Example 2-17 did not include the free-machining additives at all, Comparative Example 2-18 included the free-machining additive (e.g., $MoS_2$) less than the lower limit of the present content range, and Comparative Example 2-19 included the free-machining additive (e.g., $MoS_2$) more than the upper limit of the present content range.

The green compacts made of Examples 2-11 through 2-16 and Comparative Examples 2-17 through 2-19 were sintered at a temperature of 1,393 K. in a nitrogen ($N_2$) gas atmosphere for 1.8 Ks. Sintered bodies made of Examples 2-11 through 2-16 and Comparative Examples 2-17 through 2-19 were thus produced.

The resulting sintered bodies were examined for their wear resistance in the same manner as Examples 1-14 through 1-21 of the First Preferred Embodiments were examined. However, among the testing conditions, the valves were made of SUH37 as per JIS and built up with Stellite No. 6 building up alloy at the facings instead of being simply made of SUH3, the temperatures of the valves and the valve seats were controlled and kept at 1,073 K. and 670 K. instead of 1,023 K. and 673 K., respectively, and the cams were operated at 2,500 rpm for a running time of 36 Ks instead of at 2,000 rpm for the running time of 28.8 Ks. In particular, in this wear resistance test, the wear amounts of the valve seats were evaluated in terms of the contact width increments on the valve seats.

Further, the sintered bodies made of the Examples and the Comparative Examples were examined for their machinability. Namely, they were subjected to a mathinability test using a carbide tool in order to evaluate their resistance against machining under the following conditions:

Cutting Speed: 50 m/min.;

Feed: 0.050 mm/revolution;

Depth of Cutting: 0.5 mm; and

Measuring Device: Cutting Motor Meter.

The Examples and the Comparative Examples were thus compared in terms of the machinability by the magnitude of the resistance. The results of the wear resistance test and the measurements of the resistance are summarized in Table 7.

TABLE 7

| | Contact Width Increment on Valve Seat (μm) | Machining Resistance (Ratio to C.E. 2-17) |
|---|---|---|
| Ex. 2-11 | 96 | 0.84 |
| Ex. 2-12 | 84 | 0.87 |
| Ex. 2-13 | 93 | 0.81 |
| Ex. 2-14 | 90 | 0.83 |
| Ex. 2-15 | 94 | 0.87 |
| Ex. 2-16 | 95 | 0.82 |
| C.E. 2-17 | 92 | 1.00 |
| C.E. 2-18 | 94 | 0.98 |
| C.E. 2-19 | 126 | 0.82 |

As set forth in Table 7, the sintered bodies made of Comparative Example 2-17 free from the free-machining additives exhibited a contact width increment of 92 micrometers, whereas those made of Examples 2-11 through 2-16 exhibited a contact width increment falling in a range of 84 to 96 micrometers which were roughly equal to the contact width increment exhibited by Comparative Example 2-17. Thus, the sintered bodies made of the Examples can be said to be degraded extremely less in the wear resistance. On the other hand, the sintered bodies made of Comparative Example 2-19, including one the free-machining additives (e.g., $MoS_2$) more than the upper limit of the present content range, exhibited a remarkably enlarged contact width increment over Comparative Example 2-17, and the wear resistance was deteriorated apparently.

Regarding the machining resistance, the sintered bodies made of Examples 2-11 through 2-16 exhibited smaller ratios of the machining resistance with respect to those made of Comparative Example 2-17, and they were verified to be improved in the machinability. On the other hand, the sintered bodies made of Comparative Example 2-18 included the $MoS_2$ free-machining additive less than the lower limit of the present content range, and accordingly they were improved less in the machinability.

Third Preferred Embodiments

Examples 3-1 through 3-8

The following major raw materials were prepared by atomizing to produce Examples 3-1 through 3-8 of the Third Preferred Embodiments of the present invention:

an Fe-based atomized alloy powder 3-A including, percent by weight, 4.4% Co, 4.1% Mo and substantially the balance of Fe, and having an average particle diameter of 177 micrometers or less; and an Fe-based atomized alloy powder 3-B including, percent by weight, 4/1% Co, 7.2% Mo and substantially the balance of Fe, and having an average particle diameter of 177 micrometers or less.

Further, the following minor raw materials were roughly pulverized to have an average particle diameter of 149 micrometers or less:

a commercially available pure iron powder having an average particle diameter of 177 micrometers or less;

a ferromolybdenum powder including, percent by weight, 61% Mo, 0.60% Si, 0.030% C. and substantially the balance of Fe;

a ferrochromium powder including, percent by weight, 60% Cr, 0.30% Si, 0.0020% C. and substantially the balance of Fe; and a ferrotungsten powder including, percent by weight, 79% W, 0.20% Si, 0.030% C. and substantially the balance of Fe.

Furthermore a graphite powder, and a zinc stearate lubricant were also prepared as minor raw materials.

The major and minor raw materials were weighed by the contents set forth in Table 8 so as to make the compositions recited therein. Then, each of the resulting mixtures was formed into a green compact having a density of 6.9 g/cm$^8$.

TABLE 8

| Identification | Contents (% by weight) | | | | | | | | |
|---|---|---|---|---|---|---|---|---|---|
| | 3-A | 3-B | Pure Fe | FeMo | FeCr | FeW | Co | Mo | Gr. |
| Ex. 3-1 | B. | — | — | 10 | — | — | — | — | 0.7 |
| Ex. 3-2 | B. | — | — | — | 10 | — | — | — | 0.7 |
| Ex. 3-3 | B. | — | — | — | — | 10 | — | — | 0.7 |
| Ex. 3-4 | — | B. | — | 10 | — | — | — | — | 0.7 |
| Ex. 3-5 | — | B. | — | 10 | — | 2 | — | — | 0.7 |
| Ex. 3-6 | — | B. | — | 5 | — | — | — | — | 0.7 |
| Ex. 3-7 | — | B. | — | 15 | 10 | — | — | — | 0.7 |
| Ex. 3-8 | — | B. | — | 10 | — | — | — | — | 1.3 |
| C.E. 3-9 | — | — | B. | 10 | — | — | 4.1 | 7.2 | 0.7 |
| C.E. 3-10 | — | — | B. | — | — | 10 | 4.4 | 4.1 | 0.7 |
| C.E. 3-11 | B. | — | — | — | — | — | — | — | 0.7 |

(Note)
"B." means "balance."

In order to produce Comparative Examples 3-9 through 3-11, the following raw materials were prepared: the Fe-based atomized alloy powder 3-A, an atomized iron powder, a Co powder, an Mo powder, the ferromolybdenum powder including, percent by weight, 61% Mo, 0.60% Si, 0,030% C. and substantially the balance of Fe and roughly pulverized to have an average particle diameter of 149 micrometers, the ferrotungsten powder including, percent by weight, 79% W, 0.20% Si, 0.030% C. and substantially the balance of Fe and roughly pulverized to have an average particle diameter of 149 micrometers, a graphite powder and a zinc stearate lubricant. Likewise, they were weighed by the contents set forth in Table 8 so as to make the compositions recited therein, and each of the resulting mixtures was formed into a green compact having a density of 6.9 g/cm$^3$.

The green compacts made of Examples 3-1 through 3-8 and Comparative Examples 3-9 through 3-11 were sintered at a temperature of 1,383 K. in a decomposed ammonia gas atmosphere for 2.4 Ks. Sintered bodies made of Examples 3-1 through 3-8 and Comparative Examples 3-9 through 3-11 were thus produced.

Figure 3:
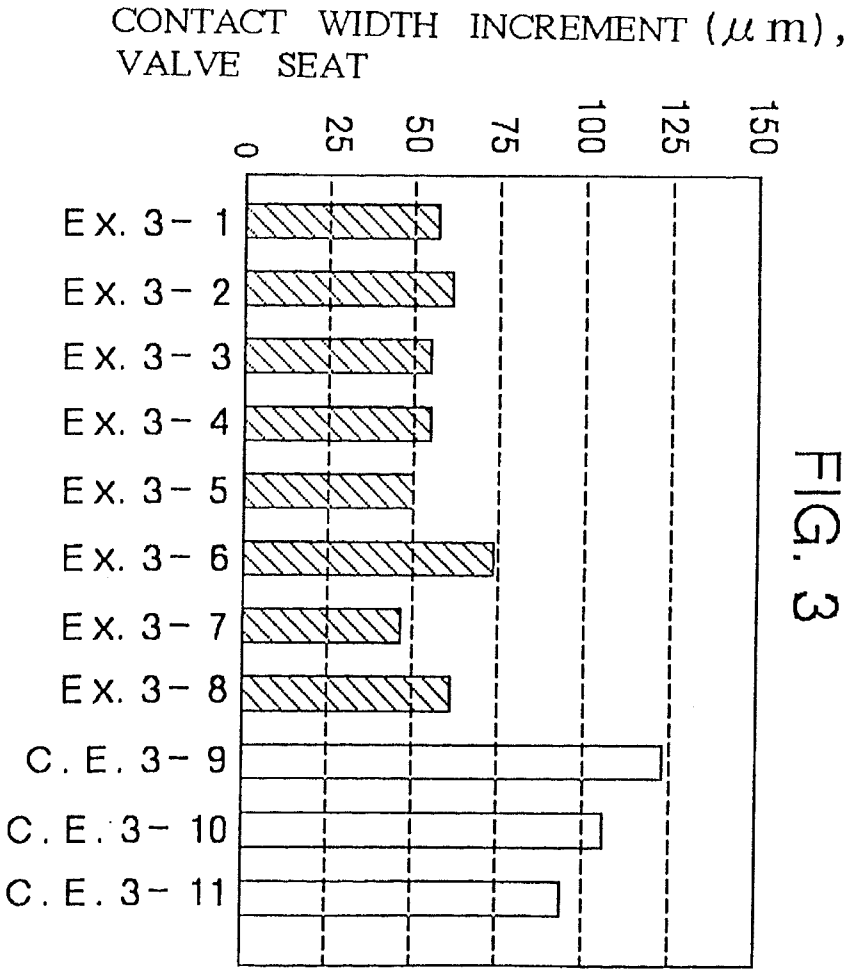
FIG. 3 is a bar chart illustrating the contact width increments exhibited by valve seats tested for the wear resistance on an apparatus simulating an actual engine, valve seats which were made of the Third Preferred Embodiments of the present invention and the Comparative Examples.

The resulting sintered bodies were examined for their wear resistance in the same manner as Examples 1-14 through 1-21 of the First Preferred Embodiments were examined. However, among the testing conditions, the valves were made of SUH4 as per JIS instead of SUH3, the temperature of the valve seats was controlled and kept at 623 K. instead of 673 K., and the cams were operated at the same rpm for a running time of 36 Ks instead of 28.8 Ks. In particular, in this wear resistance test, the wear amounts of the valve seats were evaluated in terms of the contact width increments on the valve seats. FIG. 3 illustrates the results of this wear resistance test.

As illustrated in FIG. 3, the valve seats made of the Comparative Examples exhibited a contact width increment of 90 to 120 micrometers approximately, whereas those made of the Examples exhibited a contact width increment of 45 to 75 micrometers approximately. Thus, the Fe-based sintered alloys of the present invention were verified to be superb in the wear resistance.

In particular, it is notable that, though the sintered bodies made of Example 3-3 and Comparative Example 3-11 (being free from FeW) had the same composition, and though those made of Example 3-4 and Comparative Example 3-9 have the same composition, the sintered bodies made of the Examples were worn about half as less as those made of the Comparative Examples. Thus, the Fe-based sintered alloys of the present invention were verified to be superior to the conventional sintered alloys in terms of the wear resistance. This advantageous effect results from one of the features of the present invention.

Namely, in accordance with the present invention, the Fe-Mo-C matrices are formed in the alloy powders in advance. Accordingly it is possible to form the matrices which are much more superb in the solid solution homogenizing than those of the Comparative Examples which were made by mixing the ingredient element powders. As a result, regardless of the identical compositions, it is possible to produce the present Fe-based sintered alloys having the superb wear resistance.

Fourth Preferred Embodiments

Examples 4-1 through 4-5

The following raw materials were prepared to produce Examples 4-1 through 4-5 of the Fourth Preferred Embodiments of the present invention:

an Fe-based atomized alloy powder 4-A including, percent by weight, 4.7% Mo, 5.8% Co and substantially the balance of Fe, and having an average particle diameter of 177 micrometers or less; and an Ni-based atomized alloy powder 4-B including, percent by weight, 48.3% Cr, 4.6% W, 1.9% C. and substantially the balance of Ni, and having an average particle diameter of 149 micrometers or less;

an Ni-based atomized alloy powder 4-C including, percent by weight, 47.7% Cr, 5.1% W, 0.70% Si, 2.1% C., 1.3% Nb and substantially the balance of Ni, and having an average particle diameter of 149 micrometers or less;

a graphite powder; and a zinc stearate lubricant.

The raw materials were weighed by the contents set forth in Table 9 so as to make the compositions recited therein. Then, each of the resulting mixtures was formed into a green compact having a density of 6.9 g/cm$^3$.

In order to produce Comparative Examples 4-6 through 4-9, the following raw materials, e.g., the Fe-based atomized alloy powder 4-A, the Ni-based atomized alloy powder 4-B, an atomized iron powder, a Co powder, an Mo powder, an Ni powder, an FeMo powder, a graphite powder and a zinc stearate lubricant, were weighed by the contents set forth in Table 9 so as to make the compositions recited therein. Likewise, each of the resulting mixtures was formed into a green compact having a density of 6.9 g/cm$^3$.

TABLE 9

| Identification | Alloy 4-A | Alloy 4-B | Alloy 4-C | Fe Powder | Co Powder | Mo Powder | Ni Powder | FeMo Powder | Graphite Powder | Lubricant |
|---|---|---|---|---|---|---|---|---|---|---|
| Ex. 4-1 | Balance | 4 | — | — | — | — | — | — | 0.9 | 0.8 |
| Ex. 4-2 | Balance | 14 | — | — | — | — | — | — | 0.9 | 0.8 |
| Ex. 4-3 | Balance | 24 | — | — | — | — | — | — | 0.9 | 0.8 |
| Ex. 4-4 | Balance | — | 13 | — | — | — | — | — | 0.9 | 0.8 |
| Ex. 4-5 | Balance | 14 | — | — | — | — | — | — | 1.4 | 0.8 |
| C.E. 4-6 | — | — | — | Balance | 6 | 5 | 6 | 10 | 0.8 | 0.8 |
| C.E. 4-7 | — | — | — | Balance | 12 | 5 | 12 | 10 | 0.8 | 0.8 |
| C.E. 4-8 | Balance | 14 | — | — | — | — | — | — | 0.9 | 0.8 |
| C.E. 4-9 | Balance | 14 | — | — | — | — | — | — | 0.9 | 0.8 |

The green compacts made of Examples 4-1 through 4-5 and Comparative Examples 4-6 through 4-9 were sintered in a decomposed ammonia gas atmosphere for 1.8 Ks, thereby preparing sintered bodies made of the Examples and the Comparative Examples. In particular, the green compacts made of Examples 4-1 through 4-5 and Comparative Examples 4-6 and 4-7 were sintered at a temperature of 1,403 K., those made of Comparative Examples 4-8 were sintered at a temperature of 1,273 K., and those made of Comparative Examples 4-9 were sintered at a temperature of 1,563 K.

The resulting sintered bodies were subjected to the "OHKOSHI" type wear test, to which Examples 1-27 through 1-37 of the First Preferred Embodiments were subjected, in order to examine for their wear resistance. However, among the testing conditions, the mating member was made of SUH 35 as per JIS and built up with Stellite No. 6 instead of being simply made of SUH11, the sliding speed was adjusted to 0.25 m/s instead of 0.51 m/s, the temperatures of the rotor (i.e., the mating member) and the blocks were kept at 873 K. and 673 K. instead of room temperature. In particular, in this "OHKOSHI" type wear test, the wear amounts of the blocks were evaluated in terms of the wear volume of the blocks. Table 10 summarizes the results of this wear test together with the overall compositions of the Examples and the Comparative Examples.

Figure 4:
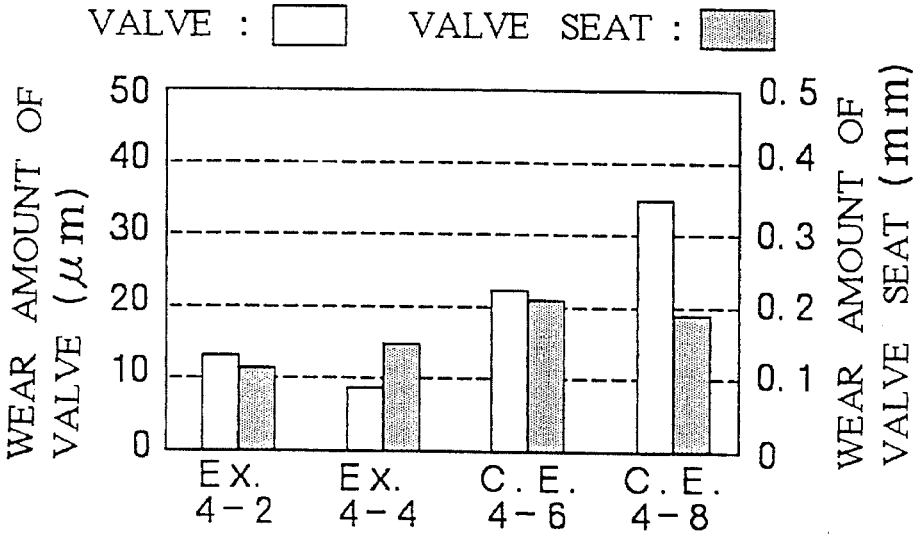
FIG. 4 is a bar chart illustrating the wear amounts exhibited by valves and valve seats examined for the durability on an actual engine, valve seats which were made of the Fourth Preferred Embodiments of the present invention and the Comparative Examples.

Further, the sintered bodies made of Examples 4-2 and 4-4 and Comparative Examples 4-6 and 4-8 were examined for their wear resistance on the actual engine in the same manner as Examples 2-1 through 2-7 of the Second Preferred Embodiments were examined. However, among the testing conditions, the actual engine was operated at a speed of 7,200 rpm for 360 Ks at full load instead of at the speed of 6,000 rpm for 628 Ks at full load, and the valves were further built up with Stellite No. 6. FIG. 4 illustrates the results of this wear resistance test.

It is appreciated from Table 10 that, though the Comparative Examples included the alloying elements in the large contents, the blocks made of the Comparative Examples exhibited a large wear volume of 73.9×10$^{-3}$ to 85.2 to 10$^{-3}$ mm$^3$ because the solid solutions took place inhomogeneously therein. On the other hand, the blocks made of the Examples exhibited a sharply reduced wear volume of 49.6×10$^{-3}$ to 67.8×10$^{-3}$ mm$^3$ with respect to those exhibited by the Comparative Examples, because the Examples employed the novel Fe-based alloy powder with the novel Ni-based hard alloy powders dispersed therein. Thus, the blocks made of the Examples were found to be superb in the wear resistance, and accordingly the advantageous effects of the present invention were verified.

TABLE 10

| Identification | Chemical Components (% by weight) | | | | | | | | | "OHKOSHI" Wear Volume |
|---|---|---|---|---|---|---|---|---|---|---|
| | Co | Mo | Ni | Cr | W | Nb | Si | C | Fe | (×10$^{-3}$ mm$^3$) |
| Ex. 4-1 | 5.5 | 4.5 | 1.8 | 1.9 | 0.17 | — | — | 0.87 | B. | 67.8 |
| Ex. 4-2 | 4.9 | 4.0 | 6.3 | 6.8 | 0.62 | — | — | 1.06 | B. | 56.3 |
| Ex. 4-3 | 4.3 | 3.5 | 10.7 | 11.5 | 1.11 | — | — | 1.26 | B. | 49.6 |
| Ex. 4-4 | 5.0 | 4.0 | 5.6 | 6.2 | 0.65 | 0.17 | 0.09 | 1.04 | B. | 52.1 |
| Ex. 4-5 | 4.8 | 3.9 | 6.3 | 6.7 | 0.63 | — | — | 1.55 | B. | 54.7 |
| C.E. 4-6 | 5.9 | 11.1 | 6.1 | — | — | — | — | 0.73 | B. | 81.3 |
| C.E. 4-7 | 12.1 | 11.0 | 12.1 | — | — | — | — | 0.72 | B. | 73.9 |
| C.E. 4-8 | 4.9 | 4.0 | 6.3 | 6.8 | 0.62 | — | — | 1.08 | B. | 81.7 |
| C.E. 4-9 | 4.9 | 4.0 | 6.4 | 6.7 | 0.62 | — | — | 1.05 | B. | 85.2 |

It is understood from FIG. 4 that the valves and the valve seats made of Examples 4-2 and 4-4 were worn about one-third to half as little as were the valves and the valve seats made of Comparative Examples 4-6 and 4-8 in the durability test on actual engine. Hence, the Fe-based sintered alloys of the present invention were verified to be applicable to the valve seats.

Fifth Preferred Embodiments

Examples 5-1 through 5-7

The following raw materials were prepared to produce Examples 5-1 through 5-7 of the Fifth Preferred Embodiments of the present invention:

an Fe-based atomized alloy powder 5-A including, percent by weight, 4.9% Mo, 2.6% Co and substantially the balance of Fe, and having an average particle diameter of 177 micrometers or less;

an Fe-based atomized alloy powder 5-D including, percent by weight, 1.2% Mo, 2.7% Co and substantially the balance of Fe, and having an average particle diameter of 177 micrometers or less;

an Fe-based atomized alloy powder 5-E including, percent by weight, 2.2% Mo, 4.6% Co and substantially the balance of Fe, and having an average particle diameter of 177 micrometers or less;

an Fe-based atomized alloy powder 5-F including, percent by weight, 3.1% Mo, 4.5% Co and substantially the balance of Fe, and having an average particle diameter of 177 micrometers or less;

an Ni-based atomized alloy powder 5-B including, percent by weight, 35.2% Cr, 12.5% W, 8.7% Mo, 18.7% Fe, 2.6% C, 0.60% Si and substantially the balance of Ni, and having an average particle diameter of 149 micrometers or less;

an Ni-based atomized alloy powder 5-C including, percent by weight, 26.7% Cr, 16.2% W, 13.3% Mo, 17.0% Fe, 2.7% C, 0.60% Si and substantially the balance of Ni, and having an average particle diameter of 149 micrometers or less;

a graphite powder; and a zinc stearate lubricant.

TABLE 11

| Identi- | Alloy Powder | | | | H.P. | | | Lubri- |
|---|---|---|---|---|---|---|---|---|
| fication | 5-A | 5-D | 5-E | 5-F | 5-B | 5-C | Gr. | cant |
| Ex. 5-1 | B. | — | — | — | 6 | — | 0.9 | 0.8 |
| Ex. 5-2 | B. | — | — | — | 11 | — | 0.9 | 0.8 |
| Ex. 5-3 | B. | — | — | — | 21 | — | 0.9 | 0.8 |
| Ex. 5-4 | B. | — | — | — | — | 11 | 0.9 | 0.8 |
| Ex. 5-5 | B. | — | — | — | 11 | — | 1.4 | 0.8 |
| Ex. 5-6 | — | — | B. | — | 11 | — | 0.9 | 0.8 |
| Ex. 5-7 | — | — | — | B. | 11 | — | 0.9 | 0.8 |
| C.E. 5-8 | B. | — | — | — | — | — | 0.9 | 0.8 |
| C.E. 5-9 | — | B. | — | — | 11 | — | 0.9 | 0.8 |

(Note)
1. "H.P." means "hard particles."
2. "B." means "balance."

TABLE 12

| Identi- | Sintered Alloy Components (% by weight) | | | | | | |
|---|---|---|---|---|---|---|---|
| fication | Co | Mo | Ni | Cr | W | C | Fe |
| Ex. 5-1 | 4.3 | 5.1 | 1.3 | 2.1 | 0.8 | 0.9 | B. |
| Ex. 5-2 | 4.1 | 5.3 | 2.4 | 3.8 | 1.4 | 1.1 | B. |
| Ex. 5-3 | 3.5 | 5.7 | 4.5 | 7.3 | 2.5 | 1.3 | B. |
| Ex. 5-4 | 4.0 | 5.8 | 2.6 | 2.8 | 1.8 | 1.1 | B. |

TABLE 12-continued

| Identi- | Sintered Alloy Components (% by weight) | | | | | | |
|---|---|---|---|---|---|---|---|
| fication | Co | Mo | Ni | Cr | W | C | Fe |
| Ex. 5-5 | 4.1 | 5.3 | 2.3 | 2.2 | 1.4 | 1.5 | B. |
| Ex. 5-6 | 4.0 | 2.8 | 2.4 | 3.9 | 1.3 | 1.1 | B. |
| Ex. 5-7 | 3.9 | 3.7 | 2.4 | 3.9 | 1.3 | 1.1 | B. |
| C.E. 5-8 | 4.8 | 4.5 | — | — | — | 0.8 | B. |
| C.E. 5-9 | 4.1 | 2.1 | 2.4 | 3.8 | 1.3 | 1.1 | B. |

(Note)
"B." means "balance."

The raw materials were weighed by the contents set forth in Table 11 so as to make the compositions recited therein. Then, each of the resulting mixtures was formed into a green compact at a forming pressure of 7 Ton/cm$^2$. The resulting green compacts were sintered at a temperature of 1,393 K. in a decomposed ammonia gas atmosphere to produce the sintered bodies made of the Examples and the Comparative Examples. Table 12 summarizes the overall compositions of the alloying elements in the sintered bodies or sintered alloys of the Examples and the Comparative Examples.

Figure 5:
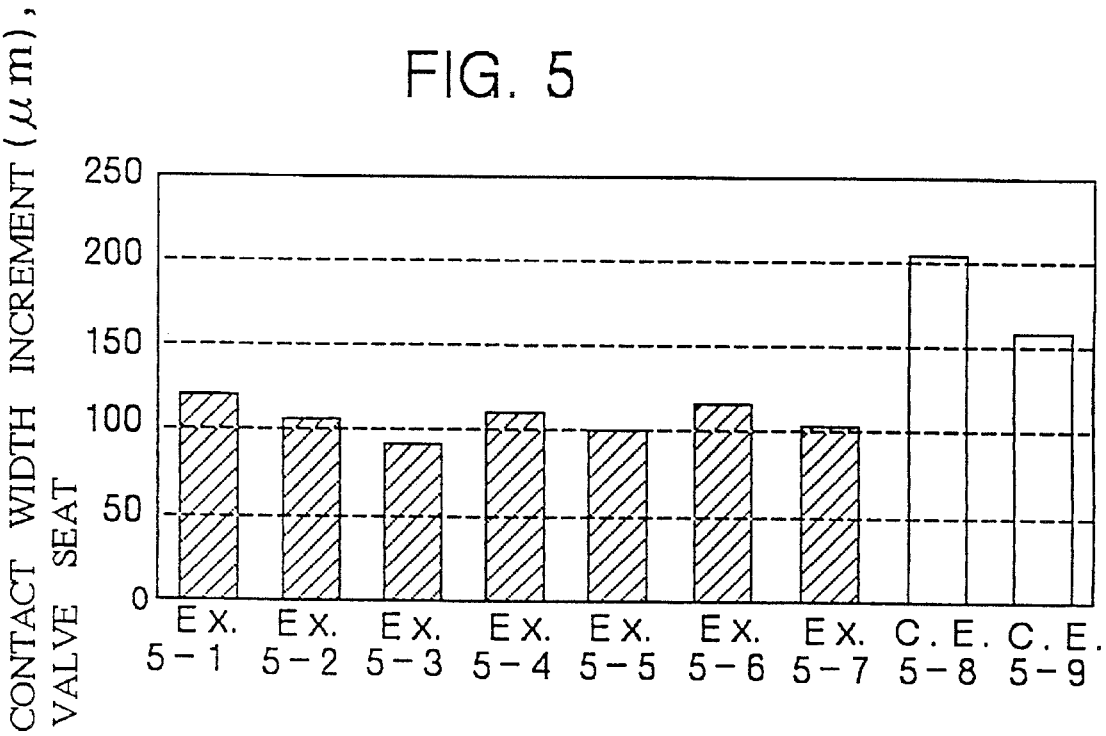
FIG. 5 is a bar chart illustrating the contact width increments exhibited by valve seats tested for the wear resistance on an apparatus simulating an actual engine, valve seats which were made of the Fifth Preferred Embodiments of the present invention and the Comparative Examples.

The resulting sintered bodies were examined for their wear resistance in the same manner as Examples 1-14 through 1-21 of the First Preferred Embodiments were examined. However, among the testing conditions, the valves were made of SUH35 as per JIS instead of SUH3, the temperatures of the valves and the valve seats were controlled and kept at 1,120 K. and 670 K., instead of 1,023 K. and 673 K., respectively, and the cams were operated at 2,200 rpm for a running time of 72 Ks instead of at 2,000 rpm for the running time of 28.8 Ks. In particular, in this wear resistance test, the wear amounts of the valve seats were evaluated in terms of the contact width increments on the valve seats. FIG. 5 illustrates the results of this wear resistance test.

As illustrated in FIG. 5, the valve seats made of Comparative Example 5-8, free from the addition of the hard particles, exhibited a contact width increment of 205 micrometers, whereas those made of the Examples exhibited a contact width increment of 89 to 123 micrometers. Thus, the Fe-based sintered alloys of the present invention were verified to be superb in the wear resistance.

Figure 6:
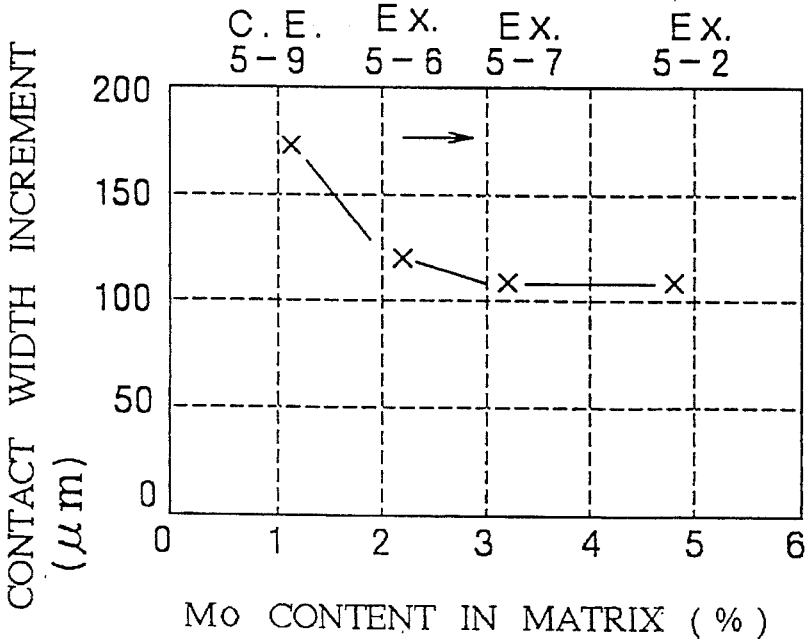
FIG. 6 is a line chart illustrating the relationship between the contact width increments and the Mo contents in the matrices, relationship which was exhibited by the Fifth Preferred Embodiments of the present invention and the Comparative Example.

FIG. 6 is a line chart, in which the Mo contents in the matrices of the alloy powders are plotted along the axis of abscissas, and the contact width increments are plotted along the axis of ordinates. It was verified from FIG. 6 that the contact width increment reduced when the Mo contents surpassed 2.0%, and that the wear resistance became stable when the Mo contents surpassed 3.0%.

Having now fully described the present invention, it will be apparent to one of ordinary skill in the art that many changes and modifications can be made thereto without departing from the spirit or scope of the present invention as set forth herein including the appended claims.

What is claimed is:

1. An Fe-based sintered alloy having superb wear resistance prepared by mixing an Fe-based alloy powder with a graphite powder and a forming lubricant, and by forming and sintering the resulting mixture;

said Fe-based alloy powder consisting, percent by weight, essentially of:

Co in an amount of 2.0 to 15%;

Mo in an amount of 2.0 to 10%; and the balance of Fe and inevitable impurities; and said graphite powder mixed in an amount of 0.20 to 2.1% by weight.

2. The Fe-based sintered alloy according to claim 1 further subjected to infiltration, thereby infiltrating and diffusing an infiltrating alloy in and around pores of said Fe-based sintered alloy;

said infiltrating alloy infiltrated in an amount of 3.0 to 25% by weight, and including at least one member selected from the group consisting of Pb, Cu, Pb-Cu alloys, and alloys containing the Pb, Cu or Pb-Cu alloys as a major component.

3. The Fe-based sintered alloy according to claim 2, wherein said infiltrating alloy is infiltrated in an amount of 5.0 to 20% by weight.

4. The Fe-based sintered alloy according to claim 1, wherein hard particles are further mixed in said resulting mixture;

said hard particles being at least one member selected from the group consisting of Fe-Mo-C, Fe-Cr-C and Fe-W-C hard particles, and mixed in an amount of 2.0 to 30% by weight in total;

said Fe-Mo-C hard particles consisting, percent by weight, essentially of Mo in an amount of 55 to 70%, C. in an amount of 0.50% or less, and the balance of Fe and inevitable impurities;

said Fe-Cr-C hard particles consisting, percent by weight, essentially of Cr in an amount of 55 to 70%, C. in an amount of 0.50% or less, and the balance of Fe and inevitable impurities; and said Fe-W-C hard particles consisting, percent by weight, essentially of W in an amount of 75 to 85%, C in an amount of 0.50% or less, and the balance of Fe and inevitable impurities.

5. The Fe-based sintered alloy according to claim 4, wherein said hard particles have an average particle diameter of 149 micrometers or less.

6. The Fe-based sintered alloy according to claim 4, wherein said hard particles are mixed in said resulting mixture in an amount of 5.0 to 25% by weight.

7. The Fe-based sintered alloy according to claim 4, wherein said graphite powder is mixed in said resulting mixture in an amount of 0.30 to 1.7% by weight.

8. The Fe-based sintered alloy according to claim 1, 2 or 4, wherein said Fe-based alloy powder includes Mo in an amount of more than 3.0% (not inclusive) and up to 10%.

9. The Fe-based sintered alloy according to claim 1, 2 or 4, wherein said Fe-based alloy powder includes Co in an amount of 2.0 to 10%.

10. The Fe-based sintered powder according to claim 1, 2 or 4, wherein said Fe-based alloy powder includes O in an amount of 0. 30% or less.

11. The Fe-based sintered alloy according to claim 1, 2 or 4, wherein said Fe-based alloy powder includes C in an amount of 20% or less.

12. The Fe-based sintered alloy according to claim 1, 2 or 4, wherein said resulting mixture is sintered at a temperature of 1,323 to 1,573 K.

13. The Fe-based sintered alloy according to claim 1, 2 or 4, wherein said graphite powder has an average particle diameter of 45 micrometers or less.

* * * * *

UNITED STATES PATENT AND TRADEMARK OFFICE

CERTIFICATE OF CORRECTION

PATENT NO. : 5,489,324

DATED : February 6, 1996

INVENTOR(S) : YOSITAKA TAKAHASI ET AL

It is certified that error appears in the above-indentified patent and that said Letters Patent is hereby corrected as shown below:

| COL. | LINE | |
|---|---|---|
| 30, | 23, | "20%" should read --0.20%--. |

Signed and Sealed this

Twenty-third Day of July, 1996

*Attest:*

Bruce Lehman

BRUCE LEHMAN

*Attesting Officer*

*Commissioner of Patents and Trademarks*